United States Patent [19]

Piatt

[11] Patent Number: 5,061,097

[45] Date of Patent: Oct. 29, 1991

[54] PRINTER CONSTRUCTION FOR HANDLING A PLURALITY OF PRINT MEDIA FORMATS

[75] Inventor: Michael J. Piatt, Enon, Ohio

[73] Assignee: Eastman Kodak Company, Rochester, N.Y.

[21] Appl. No.: 185,340

[22] Filed: Apr. 21, 1988

Related U.S. Application Data

[63] Continuation of Ser. No. 855,288, Apr. 24, 1986, abandoned.

[51] Int. Cl.[5] ..... B41J 11/00; B41J 15/04

[52] U.S. Cl. ..... 400/619; 400/647; 400/691

[58] Field of Search ..... 400/604, 610.1, 619, 400/647, 599.1, 679, 690.4, 691, 693, 647.1, 88, 713, 676, 646, 644, 603

[56] References Cited

U.S. PATENT DOCUMENTS

| | | | |
|---|---|---|---|
| 4,164,378 | 8/1979 | Yarp | 400/603 X |
| 4,452,543 | 6/1984 | Adkisson et al. | 400/605 |
| 4,504,161 | 3/1985 | Volke et al. | 400/605 |
| 4,564,305 | 1/1986 | Rekewitz et al. | 400/605 |
| 4,569,610 | 2/1986 | Drejza et al. | 400/599 |
| 4,573,815 | 3/1986 | Watanabe | 400/647.1 X |
| 4,586,839 | 5/1986 | Iwagami | 400/691 X |
| 4,641,982 | 2/1987 | Rekewitz | 400/690.4 X |

FOREIGN PATENT DOCUMENTS

| | | | |
|---|---|---|---|
| 2428354 | 1/1975 | Fed. Rep. of Germany | 400/599 |
| 3422505 | 12/1985 | Fed. Rep. of Germany | 400/647.1 |
| 2490146 | 3/1982 | France | 400/647.1 |
| 229371 | 12/1984 | Japan | 400/647.1 |
| 208274 | 10/1985 | Japan | 400/647 |

OTHER PUBLICATIONS

IBM Tech. Disc. Bulletin, "Single Sheet Insertion", Garrison et al., vol. 23, No. 9, Feb. 1981, pp. 3965-3966.

*Primary Examiner*—Clifford D. Crowder
*Attorney, Agent, or Firm*—John D. Husser

[57] ABSTRACT

A portable printer comprises a lid member forming a portion of the printer top wall, when in a closed position. The lid member is latchable in a first open position to provide a view stand for print media. The lid member is movable to a second open position to prevent re-feed of continuous web material.

8 Claims, 6 Drawing Sheets

PRINTER CONSTRUCTION FOR HANDLING A PLURALITY OF PRINT MEDIA FORMATS

This is a continuation of application Ser. No. 855,288, filed Apr. 24, 1986, now abandoned.

BACKGROUND OF THE INVENTION

1. Field of Invention

The present invention relates to printing apparatus, e.g. an ink jet printer, and more particularly to improved print media handling systems for enabling such apparatus to handle different print media formats.

2. Description of Prior Art

With the increasing popularity of computers and word processing equipment, there is a need for versatile output printers that are capable of handling different print media formats. For example popular print media formats include cut sheets and continuous webs in fanfold or roll form and exist with and without edge perforations for tractor-feeding. Various prior art approaches have been provided to allow a single printer to handle several such media format without skewing or binding of the media. U.S. Pat. No. 4,569,610 is illustrative of one such approach and employs different feed paths for the different media formats. However, high friction feed systems, such as described in that patent are bulkier, costlier and more complex than is desirable for a portable printer.

Also, it is a desirable feature for output printers to have the capability of a viewing stand mode of operation. This has been accommodated in the prior art primarily by a separate attachment which can be affixed to the printer. However, because such viewing stands are not permanently affixed, they may be forgotten when a portable printer is transported. Even if taken with the printer, they add bulk to the overall package.

Another problem, which arises with the handling of tractor-feed paper, is "re-feeding", i.e. the action of paper wrapping around and re-entering the printer, causing paper jams. Prior art solutions to this problem have included the provision of paper catching stands. However, catch stands also are subject to being left behind, add bulk and cost to the overall package and otherwise defeat the purposes of a portable printer.

SUMMARY OF THE INVENTION

Thus one significant purpose of the present invention is to provide a simple printer construction that is capable of reliably handling a variety of print media formats. One important advantage of the present invention is that it accomplishes these objectives in a construction that is readily portable. Another advantage of the invention is that the elements which implement its objectives are integral multi-purpose parts of the printer and are not subject to being left-behind. Further, constructions in accord with the present invention are compact, attractive, easily handleable and readily manufacturable.

In one aspect, the present invention provides in printer apparatus of the kind having a print media feed path including a printer ingress, a printer egress and a printing zone, an improved media handling system comprising: (a) media advancing means for moving media from a lower zone of the printer to an upper zone of the printer; and (b) printer lid means movable from a closed position, for covering the advancing means and the print zone, to a first open position for supporting print media, moving from the printer egress, in a generally vertical orientation.

In another aspect, the present invention provides in printer apparatus of the kind having a print media feed path including a printer ingress, a printer egress and a printing zone, an improved media handling system comprising: (a) media advancing means for moving media from a lower zone of the printer to an upper zone of the printer; and (b) printer lid means movable from a closed position, for covering the advancing means and the print zone, to an open position substantially blocking the printer ingress from the re-feed of print media that is egressing the printer.

BRIEF DESCRIPTION OF THE DRAWINGS

The subsequent description of preferred embodiments of the invention refers to the attached drawings wherein.

DETAILED DESCRIPTION OF THE PREFERRED EMBODIMENTS

Figure 1:
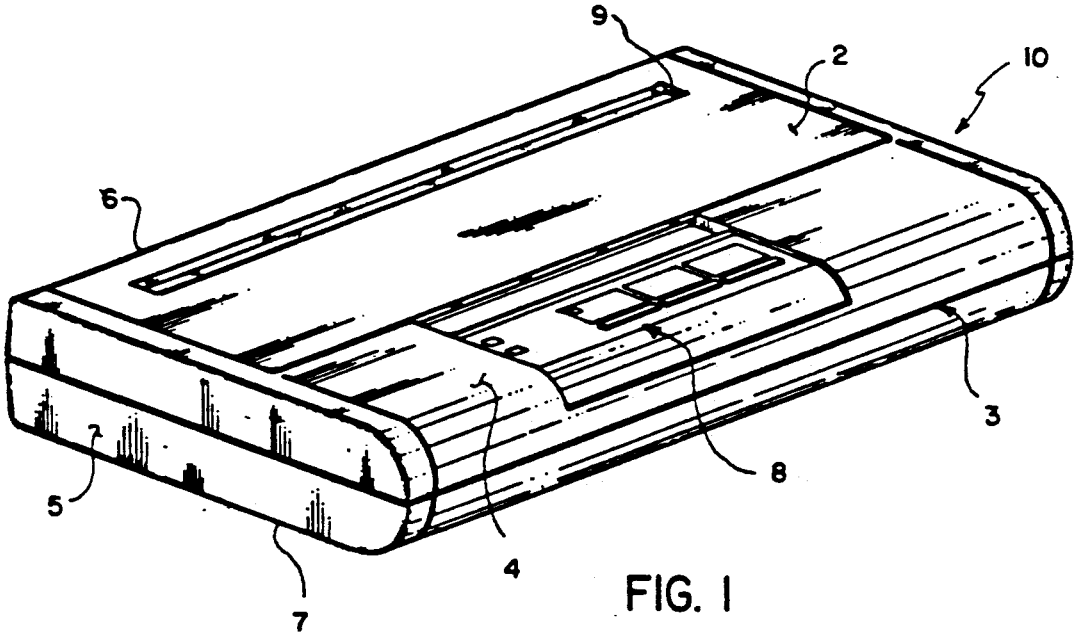
FIG. 1 is a perspective view of one embodiment of printer apparatus in accord with the present invention.

FIG. 1 illustrates one preferred embodiment of the present invention in the form of portable printer 10 with its top lid member 2 in a closed position. As can be seen, the printer has a front wall portion 3, a top wall portion 4, side wall portions 5, a rear wall portion 6 and a bottom wall portion 7. The printer front includes a control panel 8 and the lid 2 has a slot 9 for purposes to be described subsequently.

Figure 2:
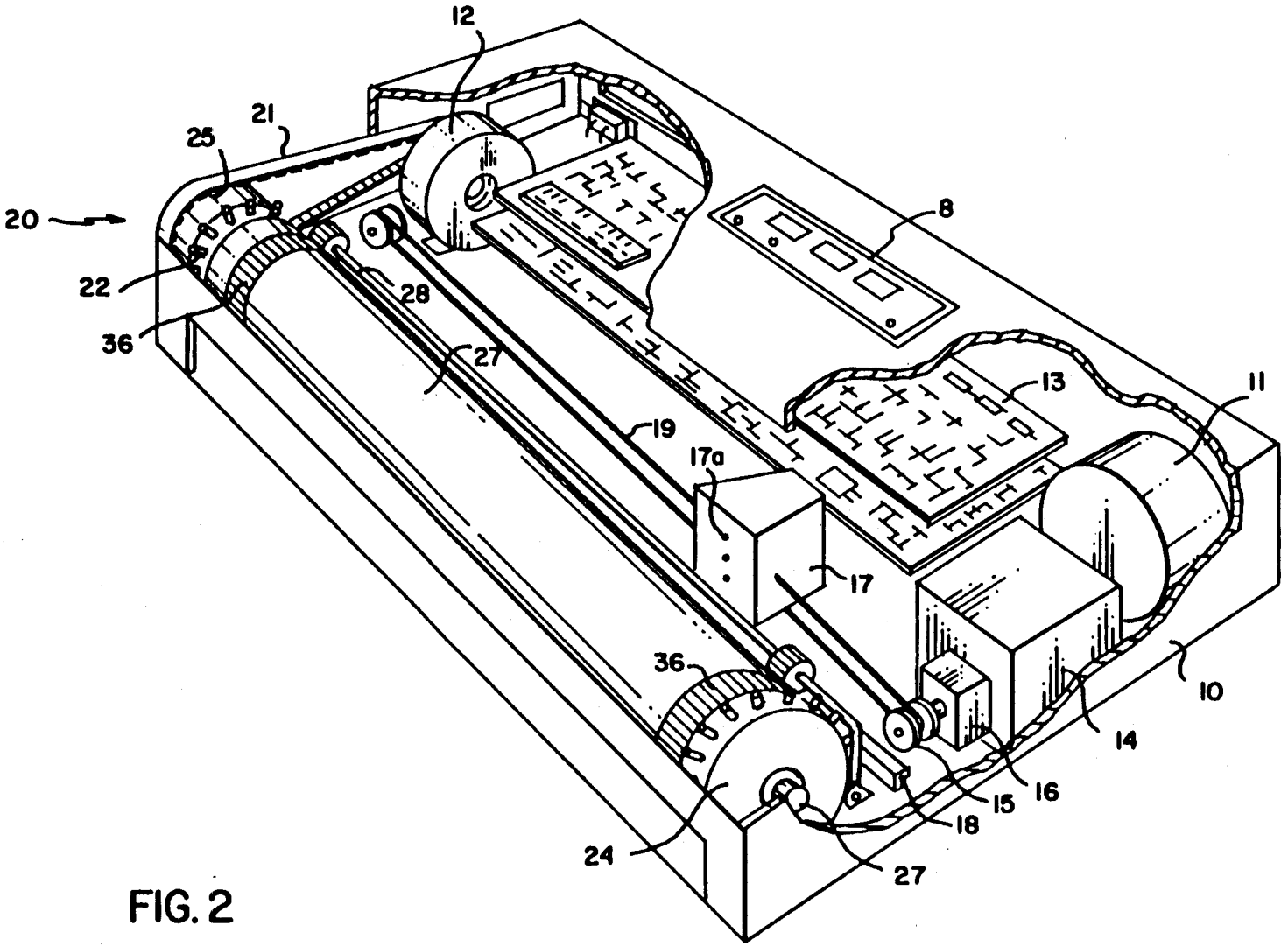
FIG. 2 is a perspective view from the rear of the FIG. 1 printer, with lid and other wall portions removed.

FIG. 2 discloses the exemplary printer embodiment 10 with lid and wall portion removed. Within printer 10 are mounted print head motor 11, platen motor 12, and printing and drive control circuit boards 13. The motor 11 is coupled via a gear reduction drive (shown generally as 14) to a cable drive spindle 15 housed in journal 16. Rotation of motor 11 traverses print head assembly 17 along its support bar 18 by virtue of its coupling to one strand of endless drive cable 19. Motor 12 is coupled to the print media transport system 20 by gear means, e.g. a gear train or geared drive belt 21. The transport system 20 is described in greater detail below, however, in general it functions as print media advancing means to move print medium, e.g. paper, from a lower zone of the printer past the transversing printing path of the print head 17, which defines a printing zone, and to an upper printer zone wherefrom the media egress the printer. Thus, under control of circuits 13, portions of the print media, e.g. paper sheets or webs, are sequentially indexed and the print head traverses across the indexed portion to effect printing, e.g. by ejected ink drops, selective thermal heating or by impact printing. That is, the ink jet print head 17 (with its ejection orifices 17*a*) is only exemplary of various printing technologies with which the present invention is useful.

Referring further to FIG. 2, it can be seen that the printer of this embodiment of the invention comprises a rotatable platen 27 having thereon sprocket teeth 22 which are constructed for advancing tractor-fed paper types. The ends 23 of the platen are coupled to end plates 24, one of which has a drive gear 25 adapted to mesh with gear means 21. Both of the platen end plates 24 have bearing surfaces adapted to support the platen for rotation on the journal surface of shafts 27 that extend from the inner side walls. A bail assembly 28 is mounted within the printer to engage friction surfaces 36 which are formed on portions of the platen periphery.

Figure 3:
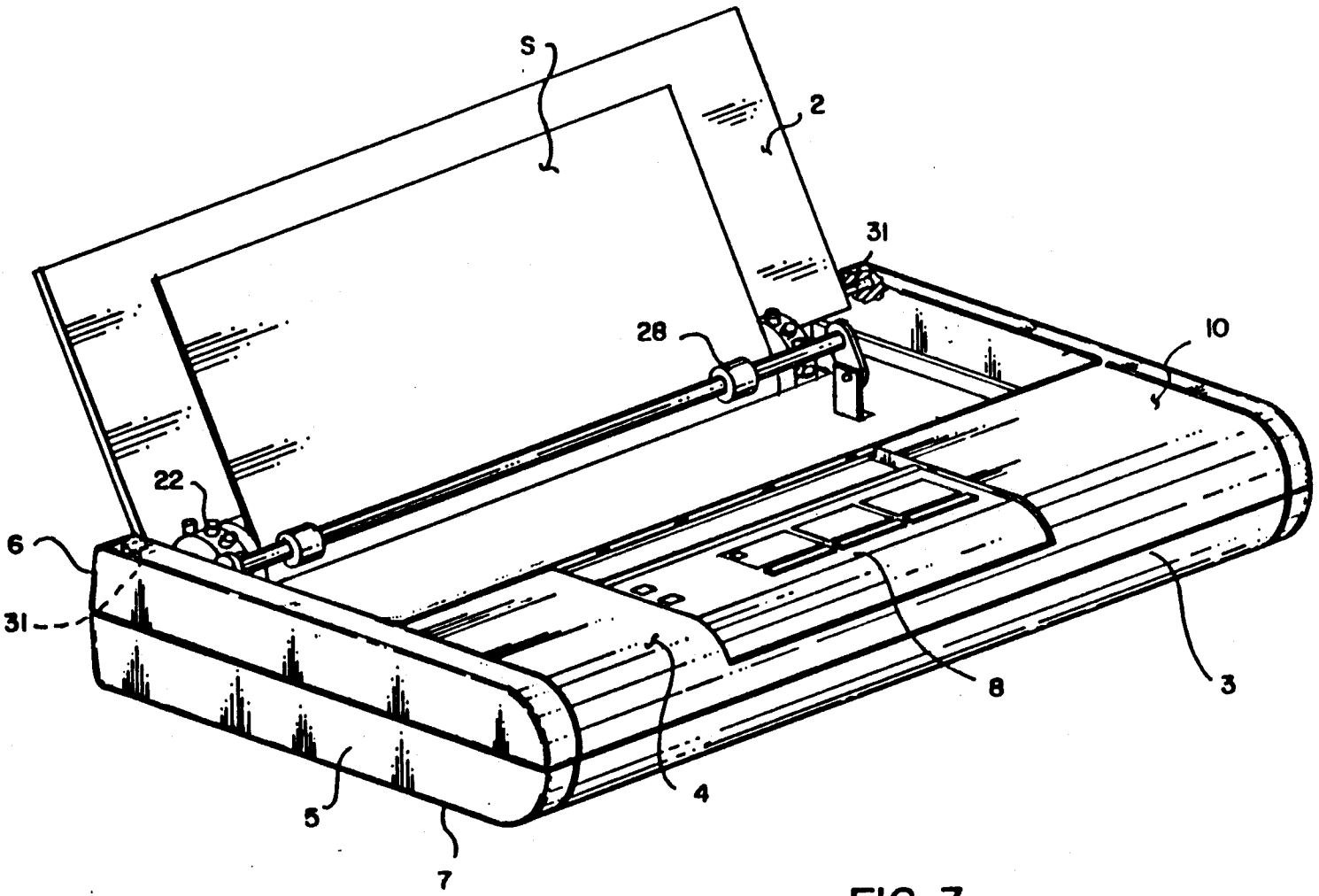
FIG. 3 is a view of the FIG. 1 printer with the printer lid in its first open position.
Figure 8:
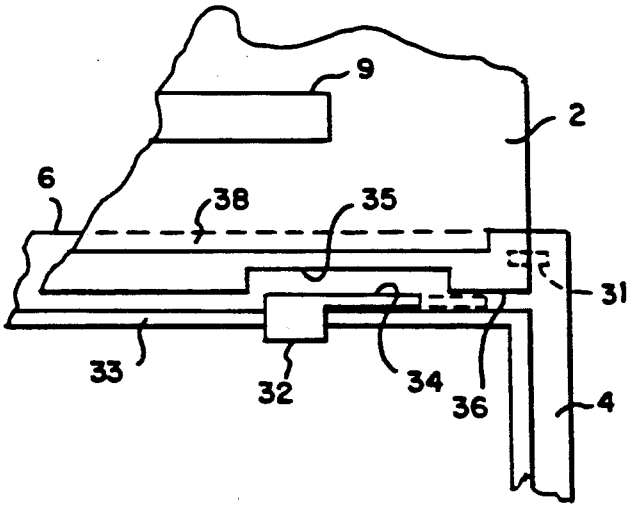
FIG. 8 is a top view of a portion of the printer with its lid open, illustrating another lid latch means useful in accord with the present invention.

Referring now to FIG. 3, the printer 10 is shown with its lid 2 in a first open position adapted to provide a view stand for a sheet S which is printed upon. Thus, lid 2 is mounted on the printer body by hinge members 31 located in the top printer portion near the rear printer wall 6. As shown in more detail in FIG. 8, the printer has a latch member 32 that is adapted to selectively support lid member 2 in the generally vertical first open position. More specifically, the latch member 32 is mounted to slide on an upstanding shoulder 33 of the printer top portion between the solid-line and dotted-line positions shown in FIG. 8. When in the solid-line position, the latch member does not engage the lid member during its pivotal movement on hinges 31 because the latch abutment portion 34 is aligned with a recessed portion 35 of the lid's edge. When the latch member is moved to the right (dotted-line position of FIG. 8), the abutment portion 34 is located to engage a cooperative abutment surface 36 on the right edge of lid 2, thereby supporting the lid in a slightly over vertical position such as shown in FIG. 3. It will be understood that various desired first open positions of lid 2 can be achieved by proper cooperative design of portion 35 and surface 36, and the terminology "generally vertical" is used herein to describe those useful view stand orientations of the lid.

Figure 7A:
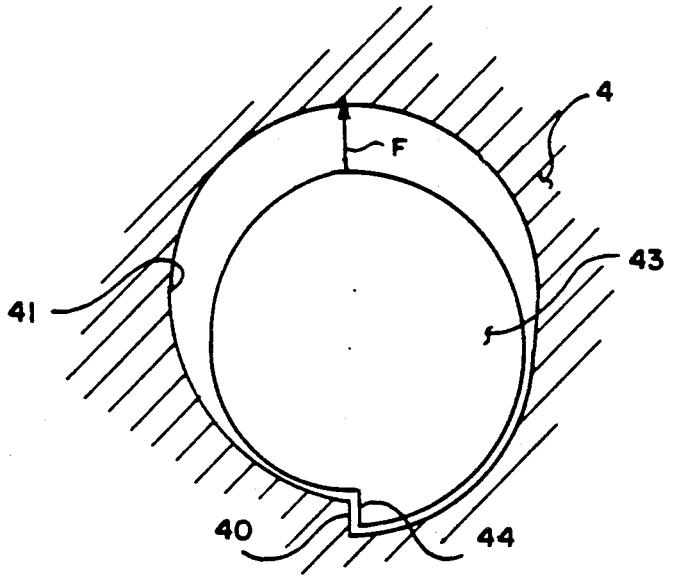
FIGS. 7A–7C are cross-sectional views illustrating one lid latch means in accord with the present invention.
Figure 7B:
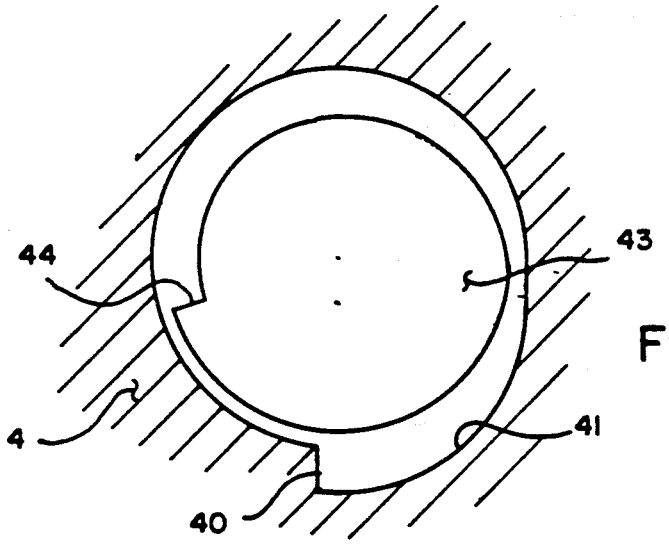
Figure 7C:
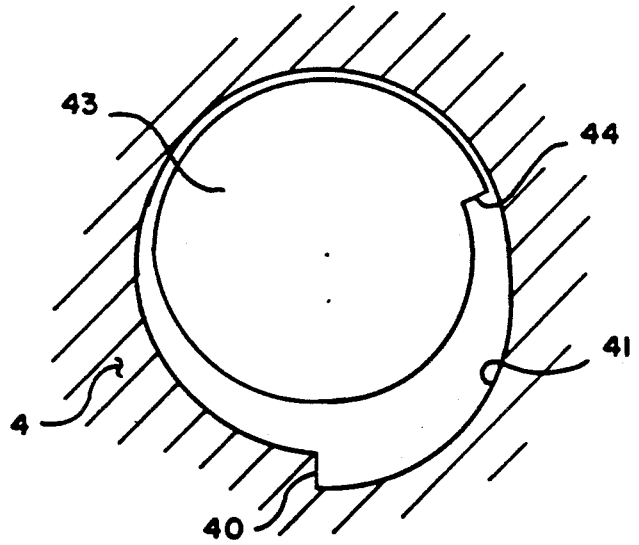

An alternative latch means for selectively supporting lid 2 in a desired first open position is illustrated schematically in FIGS. 7-A, 7-B and 7-C. In this embodiment the hinge portion of upper wall 4 is formed with an abutment surface 40 within the hinge bearing cavity 41, which is slightly larger than the cooperative hinge pin portion 43 that is formed on the lid 2 for rotation in cavity 41. As shown, pin portion 43 also has an abutment portion 44. During the pivoting opening movement of the lid 2, pin portions 43 of the lid rotate within the bearing cavity 41 to the FIG. 7-A or FIG. 7-C positions.

FIG. 7-A correspond to the lid position shown in FIGS. 3 and, as shown in FIG. 7-A, the abutment surface 40 and abutment portion 44 are in engagement to support the lid in the desired generally-vertical, view stand position. FIG. 7-C corresponds to the lid closed position shown in FIG. 1, and FIG. 7-B corresponds to a second fully open lid position shown in FIG. 4. In operation, commencing with the lid 2 in the closed position as shown in FIG. 1, the hinge assembly is in the orientation shown in FIG. 7-C. As the lid is lifted, the pin portion moves to the FIG. 7-A position where the lid 2 can be used as a view stand. If desired, the lid 2 can be further open by exerting lifting force to move the lid 2 upwardly in the direction shown as F, FIG. 7-A. This disengages the abutment portion 44 from abutment surface 40 and allows continued movement of the lid to the FIG. 4, FIG. 7-A position. On closing from that fully open position, the portion 44 rides over the abutment surface 40 to allow return to the closed position without any catching of the lid at the view stand position.

Figure 4:
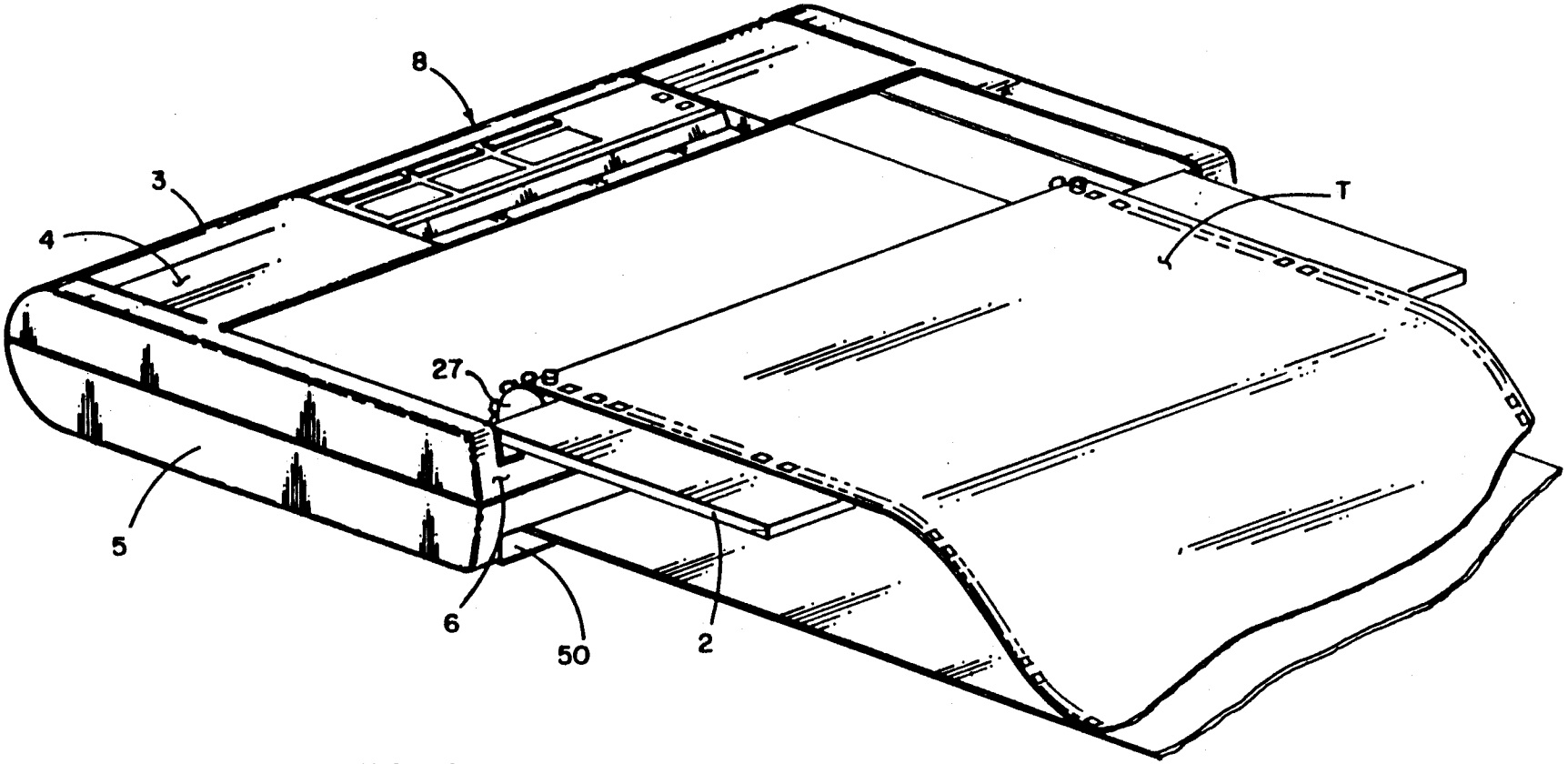
FIG. 4 is a view of the FIG. 1 printer with the printer lid in its second open position.
Figure 6:
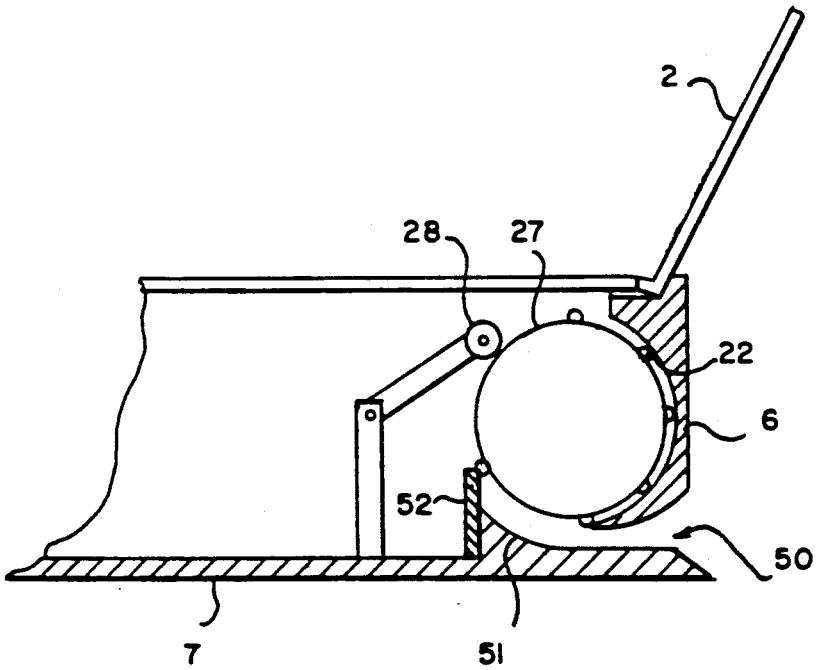
FIG. 6 is a schematic cross section illustrating the ingress path of the FIG. 1 apparatus.

Referring now to FIGS. 4 and 6, it can be seen that the lower portion of rear wall 6 of printer 10 comprises a wide throated media ingress 50. As best seen in FIG. 6, the inner surface of the bottom wall 7 is formed with a raised arcuate surface 51 adapted to direct the leading edge of media, which has been inserted into ingress 50, upwardly toward the front of platen 27. A resilient member 52 can be affixed to the bottom wall 6 to further guide the leading media edge into proper relation with the printing zone of the apparatus. Bail 28 is provided to maintain upper portions of the print media in contact with portions 36 of platen 27, so that the media moves with the platen and egresses from the printer top, either onto the lid 2 or through slot 9, as subsequently explained in more detail.

Referring again to FIG. 4, it can be seen that lid 2 is in its second open position, which is useful for tractor-feed media T to prevent re-feed of the media back into printer ingress 50. Thus, in the second open position, lid 2 extends rearwardly from the printer in a manner substantially blocking the ingress 50 from the media that passes out of the printer egress. In addition to such blocking of the ingress, the rearward extension of the lid guides the output medium in a direction generally opposite the input medium. This significantly deters curling of the output medium into an orientation susceptible to re-feed. As shown more clearly in FIG. 8, lid means 2 is hinged slightly inwardly from its rear edge so that an underlying portion 38 of the rear wall 6 supports the lid generally horizontally.

Figure 5:
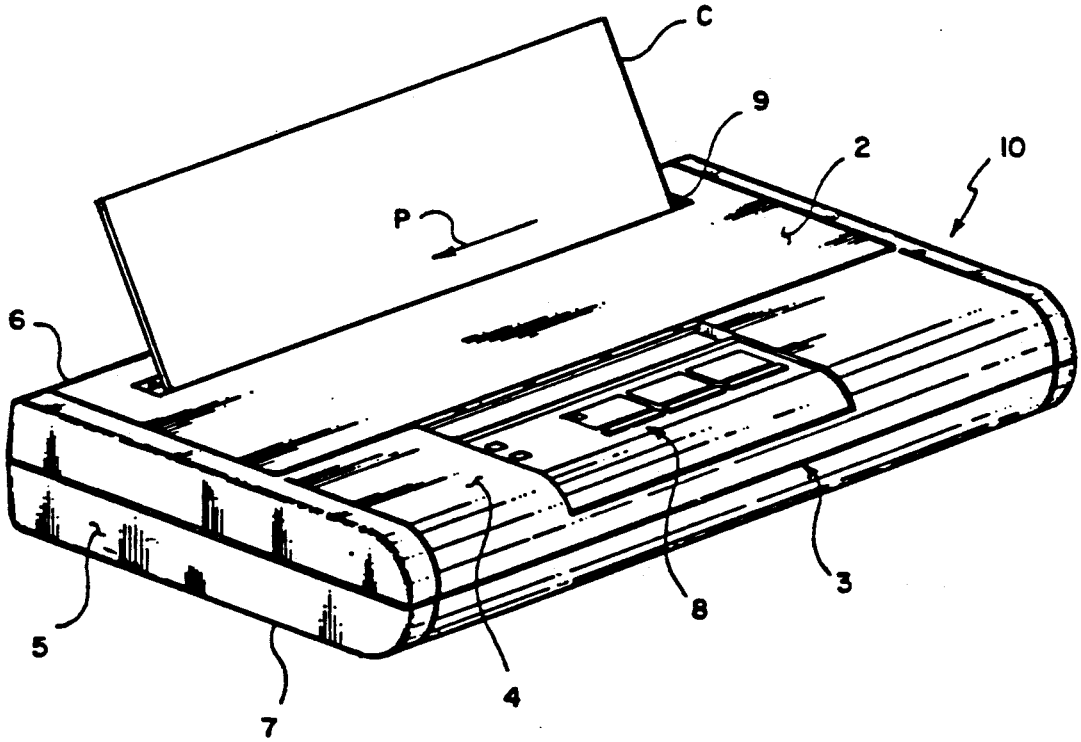
FIG. 5 is a view of the FIG. 1 printer with its lid in a closed position and in operation with its slot guiding a print medium.

FIG. 5 illustrates the mode of printer operation preferred for continuous (e.g. fanfold or roll) print media C, that is not perforated for tractor feed. As shown in FIG. 5, slot 9 is only slightly wider than such print media. In operation, the lid is first lifted to the first open position and the leading edge of the continuous print media is fed into ingress 50. Bail 28 is lifted and the leading media edge is fed through slot 9. The bail is next moved to its engaging position shown in FIG. 6 and the lid 2 is returned to the closed position as shown in FIG. 5. If, during printing operation, the continuous print media beings to slip between the bail and platen, a skewed printing condition is prevented by the edges of slot 9 contacting the edge of the print medium, thus exerting a pressure, e.g. in the direction indicated by P in FIG. 5. Because the lid 2, in its closed position, is spaced closely to the bail wheels, the force P that prevents print media skewing is not great enough to crease the print media or cause a bind at the point of contact.

The invention has been described in detail with particular reference to preferred embodiments thereof, but it will be understood that variations and modifications can be effected within the spirit and scope of the invention.

I claim:

1. A portable printer of the kind having a housing providing front, rear, and side walls, a print platen located between said side walls for advancing print media through a print zone and printing means for traversing said print zone, said printer further comprising:

(a) guide means, defining a continuous or sheet type print media ingress path having an inlet opening in the rear wall of said housing, for directing print media from said inlet opening under said print platen and then upwardly along the printer front side of said platen, through said print zone;

(b) top wall means having an opening sized to provide manual access to said print platen and said printing means; and (c) a generally flat lid means, hinged rearwardly of said print platen, and sized to interfit over said top wall opening in a condition generally flush with said top wall means when moved to a closed position, said lid means being mounted for pivotal movement of approximately 180° to a fully open position wherein it is generally parallel with the top surface of said top wall means and wherein a major portion of said lid means extends rearwardly of said rear wall to inhibit refeed of continuous type print media into said inlet opening.

2. The invention defined in claim 1 further comprising abutment means for selectively retaining said lid means, between said closed and fully open lid positions, in a generally vertical position and at a location for view-stand support of sheet type media fed out of said print zone.

3. The invention defined in claim 2 comprising means for releasing said retaining means to allow movement of said lid means to said fully open position.

4. The invention defined in claim 1 wherein said lid means comprises a slot opening constructed to be aligned over said print zone when said lid is in said closed position and having guide edges located to urge print media egressing therethrough into proper alignment at said print zone.

5. The invention defined in claim 1 wherein said lid means is hinged so that the rear wall of said printer supports said lid means, in its fully open position.

6. A portable printer of the kind having a printing zone, a print platen for advancing print media through a print zone, means for printing on print media at said print zone and exterior housing means for enclosing said platen and said printing means, said printer comprising:

(a) media inlet means including an inlet opening in a lower rear wall portion of said housing means and guide means for directing print media from said inlet opening, under said print platen and around the front side of said print platen to said print zone;

(b) a top wall portion of said housing having a top wall opening that provides manual access to said platen and said printing means;

(c) lid means, pivotally coupled to said top wall housing portion at a position rearward of said printing zone for movement between fully closed and fully open positions, said lid means being constructed to interfit over said top wall opening, generally flush with said housing exterior, when in said closed position and being movable to extend generally parallel with the top surface of said printer with a major portion of said lid means protruding rearwardly of said rear wall when in said fully open position; and (d) means for selectively holding said lid means, between said closed and fully open lid positions, in a view-stand position wherein said lid means can receive and supports sheet media egressing said print zone.

7. The invention defined in claim 6 wherein said lid means comprises a slot opening constructed to be aligned over said print zone when said lid is in said closed position and having guide edges located to urge print media egressing therethrough into proper alignment at said print zone.

8. The invention defined in claim 6 comprising means for releasing said holding means to allow movement of said lid means to said fully open position.

* * * * *